US010637194B1

(12) United States Patent
Kim et al.

(10) Patent No.: US 10,637,194 B1
(45) Date of Patent: Apr. 28, 2020

(54) CONNECTOR DEVICE

(71) Applicants: Hyundai Motor Company, Seoul (KR); KIA Motors Corporation, Seoul (KR); Sumitomo Wiring Systems, Ltd., Mie-ken (JP)

(72) Inventors: Jong Hwi Kim, Hwaseong-si (KR); Cheol Hun Lee, Suwon-si (KR); Min Ho Lee, Yongin-si (KR); Hideto Nakamura, Seongnam-si (KR)

(73) Assignees: Hyundai Motor Company, Seoul (KR); KIA Motors Corporation, Seoul (KR); Sumitomo Wiring Systems, Ltd., Mie-ken (JP)

( * ) Notice: Subject to any disclaimer, the term of this patent is extended or adjusted under 35 U.S.C. 154(b) by 0 days.

(21) Appl. No.: 16/370,071

(22) Filed: Mar. 29, 2019

(30) Foreign Application Priority Data

Nov. 14, 2018 (KR) ..... 10-2018-0140160

(51) Int. Cl.
*H01R 13/639* (2006.01)
*H01R 13/506* (2006.01)
*H01R 13/627* (2006.01)

(52) U.S. Cl.
CPC ..... *H01R 13/639* (2013.01); *H01R 13/506* (2013.01); *H01R 13/6272* (2013.01)

(58) Field of Classification Search
CPC ..... H01R 13/639
See application file for complete search history.

(56) References Cited

U.S. PATENT DOCUMENTS 6,354,860 B1 * 3/2002 Miller ..... H01R 13/6272 439/352
7,559,787 B2 * 7/2009 Shigeta ..... H01R 13/6272 439/358
7,591,665 B2 * 9/2009 Nakamura ..... H01R 13/5812 439/374
7,591,668 B2 * 9/2009 Nakamura ..... H01R 13/641 439/489
7,722,385 B2 * 5/2010 Nakamura ..... H01R 13/6272 439/352
8,016,606 B1 * 9/2011 Kwan ..... H01R 13/641 439/352
8,366,493 B2 * 2/2013 Nakamura ..... H01R 13/4223 439/752
8,628,344 B2 * 1/2014 Cole ..... H01R 13/6272 439/352

(Continued)

FOREIGN PATENT DOCUMENTS

KR 100818629 B1 4/2008

*Primary Examiner* — Ross N Gushi
(74) *Attorney, Agent, or Firm* — McDonnell Boehnen Hulbert & Berghoff LLP

(57) ABSTRACT

The present disclosure provides a connector device capable of simplifying an assembly work for a counterpart connector. In particular, the present disclosure provides a connector device where a work direction of a main connector and a work direction of a connector position assurance (CPA) device are the same as each other. Further, the present disclosure provides a connector device that prevents unintentional unlocking due to carelessness with a bridge part formed on the CPA device wrapping an elastic arm that determines a locked state.

8 Claims, 6 Drawing Sheets

(56) References Cited

U.S. PATENT DOCUMENTS

| | | | | |
|---|---|---|---|---|
| 8,678,846 | B2 * | 3/2014 | Hitchcock | H01R 13/6272 439/352 |
| 9,142,919 | B2 * | 9/2015 | Osada | H01R 13/6272 |
| 9,543,687 | B2 * | 1/2017 | Horiuchi | H01R 13/502 |
| 9,543,697 | B2 * | 1/2017 | Nakashima | H01R 13/6272 |
| 10,305,221 | B2 * | 5/2019 | Ohfuku | H01R 13/641 |
| 2016/0123361 | A1 * | 5/2016 | Horiuchi | H01R 13/533 403/42 |

* cited by examiner

CONNECTOR DEVICE

CROSS REFERENCE TO RELATED APPLICATION

The present application claims priority to Korean Patent Application No. 10-2018-0140160, filed Nov. 14, 2018, the entire contents of which are incorporated herein for all purposes by this reference.

BACKGROUND

1. Technical Field

The present disclosure relates to a connector device, and more particularly, to a connector device for preventing a locked state between connectors from being unintentionally unlocked.

2. Description of the Related Art

In certain industrial applications, electrical connectors must be stably connected to one another. Such electrical connectors typically have a primary latch and a primary striker for locking a connector housing relative to one another. In addition, a connector position assurance (CPA) device is provided for locking a locking member as an additional locking assurance part.

Before the connector is coupled to a corresponding engaging connector, the CPA is placed in an initial position that allows the primary latch and striker to move relative to each other. That is, when a connector housing of a first connector is connected to a corresponding connector housing of a second connector and the primary latch and striker are coupled to each other, the CPA may be moved to a final position within the connector housing to prevent the primary latch and striker from being decoupled, thereby ensuring a locked state of the first connector and the second connector.

However, according to the related art, the CPA has to be fastened separately at an upper end of the connector housing and a locking part for fastening is exposed at the upper end of the connector housing. Therefore, as a CPA insertion work is performed after fastening the connector housing of the first connector and the corresponding connector housing of the second connector to each other, the number of work processes is increased, and since the locking part is exposed at the upper end of the connector housing, the locked state is unintentionally unlocked due to carelessness.

The contents described as the related art have been provided only to assist in understanding the background of the present disclosure and should not be considered as corresponding to the related art known to those having ordinary skill in the art.

SUMMARY

An object of the present disclosure is to provide a connector device that prevents a locking part of a CPA from being easily unintentionally unlocked by wrapping the locking part of the CPA.

According to an embodiment of the present disclosure, a connector device includes: a counterpart connector having a locking protrusion formed thereon; a main connector including a locking arm which is elastically flexural deformable, and maintaining a coupled state with the counterpart connector as the counterpart connector is inserted thereinto and the locking arm is caught by the locking protrusion; a connector position assurance (CPA) device formed to wrap the main connector, having an accommodating part into which the main connector is inserted therein, and including an elastic arm caught by the locking arm and flexural deformed together with the locking arm when the main connector is inserted into the accommodating part, wherein the elastic arm is caught by the locking arm to restrict movement of the CPA device when the counterpart connector and the main connector are assembled; and a bridge part protruding from the CPA device and extended upwardly to wrap the elastic arm, and having an opening inwardly exposing the elastic arm.

The main connector may be provided with a terminal fastening part for terminal connection, and the locking arm is connected to an upper end of the terminal fastening part to be deformable in a vertical direction.

The locking arm may include: an elastic supporting part upwardly protruding from the terminal fastening part and formed to be elastically deformable; and a locker body coupled to the elastic supporting part, formed to be extended in a front-rear direction to seesaw around the elastic supporting part, and formed with an assembly space into which the elastic arm of the CPA device is inserted.

The locker body may include a coupling part forming a lower end portion and coupled to the elastic supporting part, and a plate-shaped part forming an upper end portion and closing an upper side of the assembly space, a catching jaw caught by the locking protrusion of the counterpart connector is formed at a front end portion of the locker body, and a rear end portion of the locker body is opened toward the assembly space.

In a state in which the elastic arm is inserted into the assembly space of the locker body, a hooking jaw which is in contact with and supported by the catching jaw may be formed on the elastic arm.

An upper end portion of the CPA device may be provided with a CPA catching part extending in a width direction to be deformably connected to both side ends of the CPA device in the vertical direction and having the elastic arm formed thereon.

The CPA catching part may include an extending part disposed in a rear direction from the upper end portion of the CPA device and extending in the width direction, the elastic arm extending in a front direction from the extending part, connection parts extending in the front direction from both end portions of the extending part and then connected to both side ends of the CPA device, and a cover part upwardly spaced apart from the elastic arm and connected between the connection parts.

A catching ring is formed on the main connector, and a separation preventing arm corresponding to the catching ring is formed on the CPA device, such that the catching ring may be caught by the separation preventing arm to prevent the main connector from being separated from the CPA device.

The bridge part may be disposed at a rear end portion of the CPA device, and connect both side ends of the CPA device in a width direction and be formed in an arch shape to form an opening therein.

DETAILED DESCRIPTION

Hereinafter, a connector device according to embodiments of the present disclosure will be described with reference to the accompanying drawings.

Figure 1:
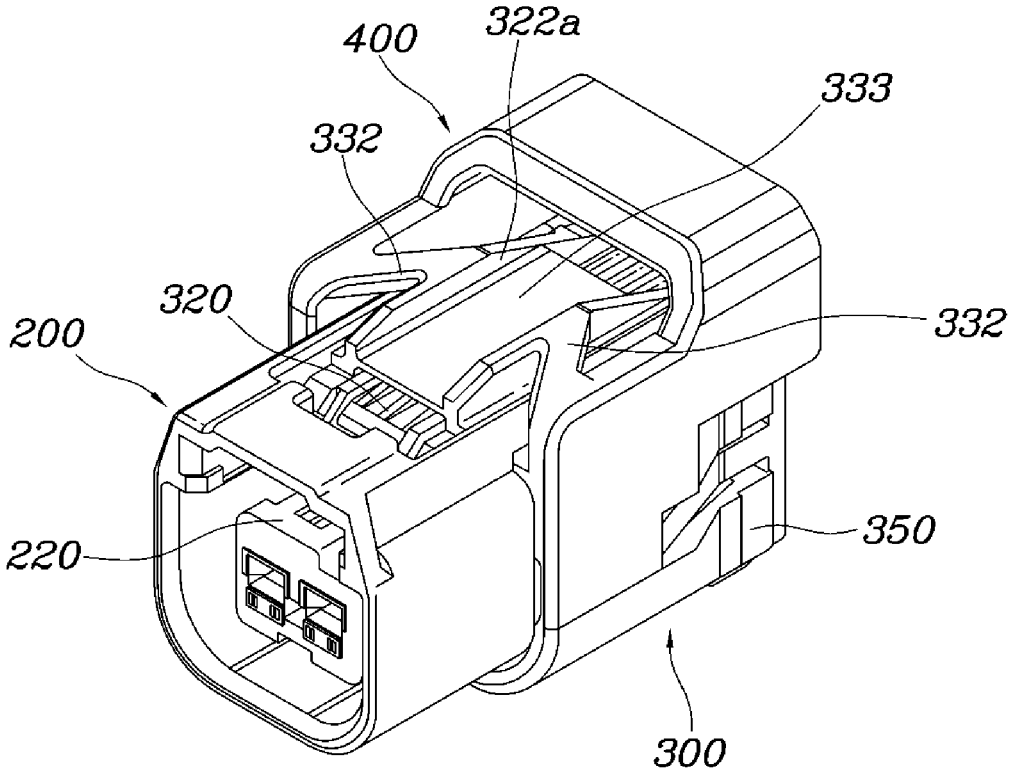
FIG. 1 is a front perspective view illustrating a connector device, according to an embodiment of the present disclosure.

FIG. 1 is a view illustrating a connector device according to an embodiment of the present disclosure and FIGS. 2 to 6 are views for describing the connector device illustrated in FIG. 1.

Figure 2:
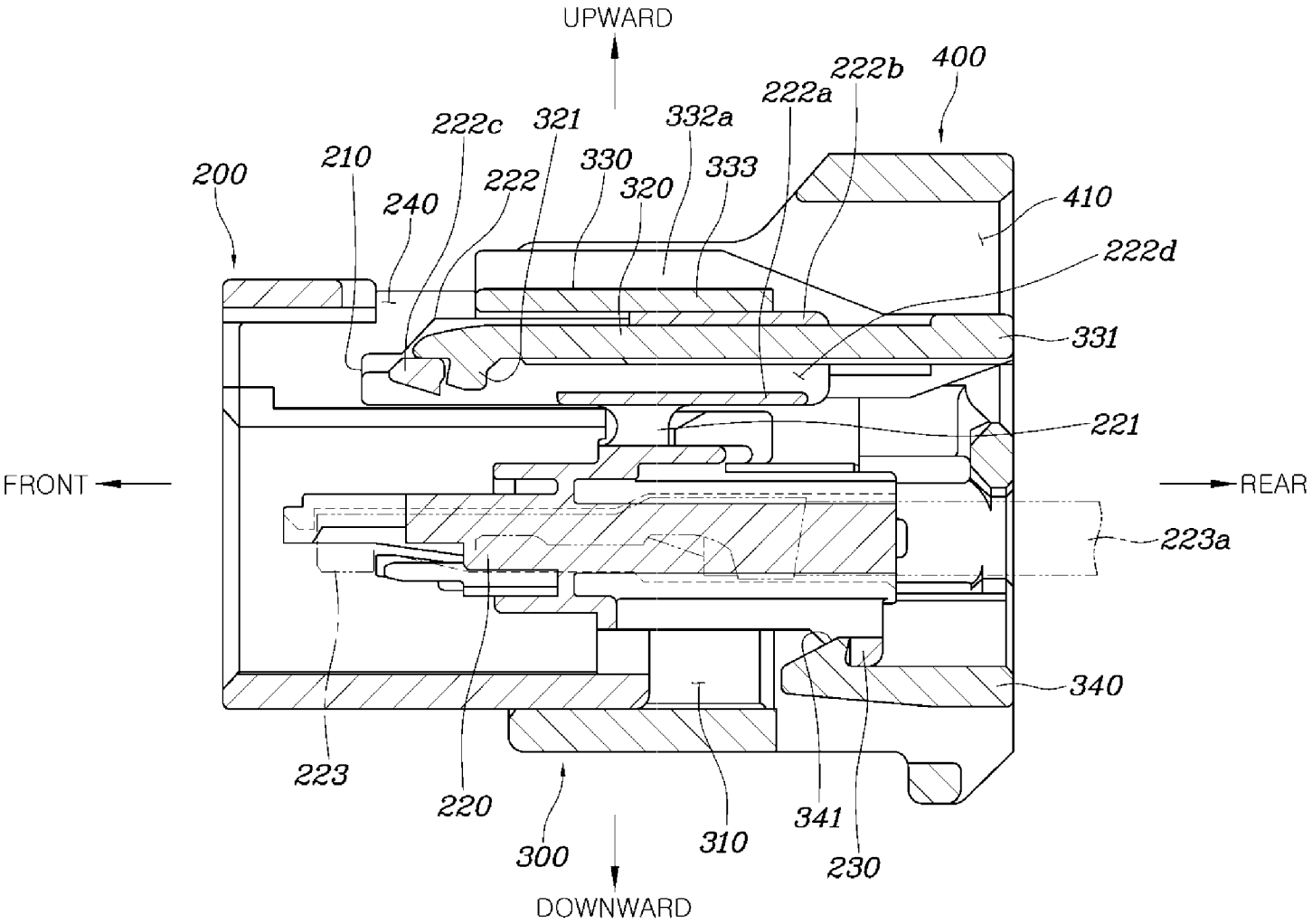
FIG. 2 is a side cross-section view illustrating the connector device of FIG. 1 with a main connector partially inserted into the accommodating part, according to an embodiment of the present disclosure.

A connector device according to the present disclosure includes a counterpart connector 100 having a locking protrusion 110 formed thereon; a main connector 200 including a locking arm 210 which is elastically flexural deformable, and maintaining a coupled state with the counterpart connector 100 as the counterpart connector 100 is inserted thereinto and the locking arm 210 is caught by the locking protrusion 110; a connector position assurance (CPA) device 300 formed to wrap the main connector 200, having an accommodating part 310 into which the main connector 200 is inserted therein, and including an elastic arm 320 caught by the locking arm 210 and flexural deformed together with the locking arm 210 when the main connector 200 is inserted into the accommodating part 310, wherein the elastic arm 320 is caught by the locking arm 210 to restrict movement of the CPA device 300 when the counterpart connector 100 and the main connector 200 are assembled; and a bridge part 400 protruding from the CPA device 300 and extended upwardly to wrap the elastic arm 320, and having an opening 410 inwardly exposing the elastic arm 320, as illustrated in FIGS. 1 and 2.

As described above, according to the present disclosure, the counterpart connector 100, the main connector 200, and the CPA device 300 are provided, when the main connector 200 and the CPA device 300 are assembled toward the counterpart connector 100, the locking arm 210 is caught by the locking protrusion 110 such that the main connector 200 and the counterpart connector 100 are locked to each other, and the elastic arm 320 is caught by the locking arm 210 such that the CPA device and the main connector 200 are locked to each other. Here, in a case in which the elastic arm 320 is manipulated and deformed, the locking arm 210 is rotated together with the elastic arm 320 and is separated from the locking protrusion 110, thereby releasing a locked state.

In particular, according to the present disclosure, the bridge part 400 protruding from the CPA device 300 to wrap the elastic arm 320 is formed such that an unintentional manipulation of the elastic arm 320 is avoided by the bridge part 400. Such a bridge part 400 is provided with the opening 410 inwardly exposing the elastic arm 320, and as a result, in order to manipulate the elastic arm 320, it is necessary to manipulate the elastic arm 320 after inserting an operator's finger into the opening 410 of the bridge part 400. Accordingly, an unlocking operation through the CPA device 300 is performed only by an action intended by the operator.

Figure 3:
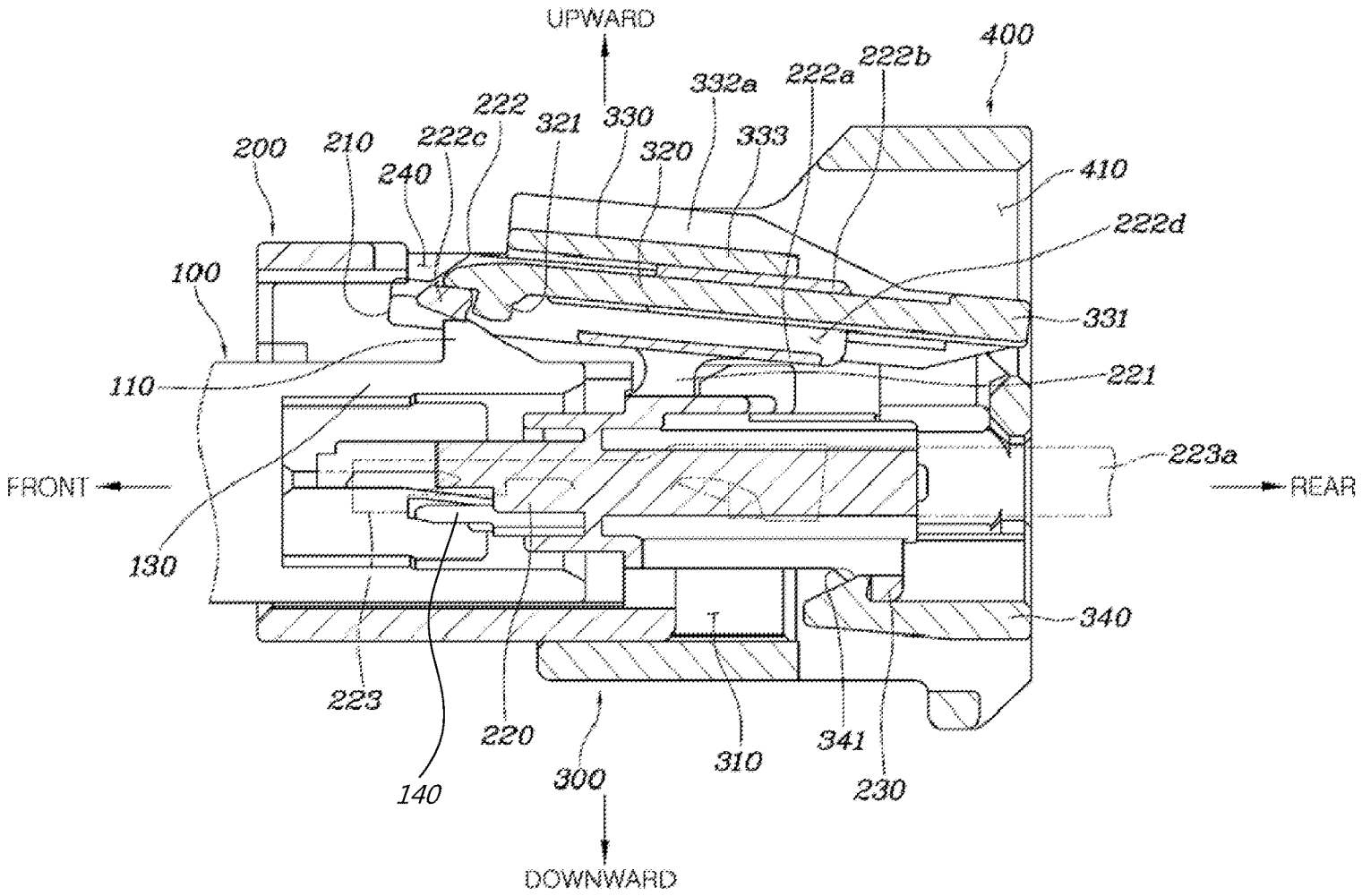
FIG. 3 is a side cross-section view illustrating the connector device of FIG. 1 with a counterpart connector partially inserted into the main connector, according to an embodiment of the present disclosure.

As illustrated in FIG. 3, the counterpart connector 100 may be formed of a synthetic resin, and a hood part 130 inserted into the main connector 200 is formed. A terminal part extends in the hood part 130 and the locking protrusion 110 protrudes from an upper end of the hood part 130.

Meanwhile, the main connector 200 may be formed of a synthetic resin, and is provided with a terminal fastening part 220 for terminal connection with the terminal part of the counterpart connector 100 and the locking arm 210 which is elastically flexural deformable. Here, the terminal fastening part 220 includes a terminal component 223 into which the terminal part of the counterpart connector 100 is inserted, and an electrical wire 223*a* is electrically and mechanically connected to the terminal component 223.

Such a main connector 200 is provided with a catching ring 230 and the CPA device 300 is provided with a separation preventing arm 340 corresponding to the catching ring 230, such that the catching ring 230 is caught by the separation preventing arm 340 to prevent the main connector 200 from being separated from the CPA device 300. Thereby, as illustrated in FIG. 2, before the main connector 200 and the CPA device 300 are assembled to the counterpart connector 100, a catching protrusion 341 formed on the separation preventing arm 340 is disposed so as to be in contact with the catching ring 230 and be caught by the catching ring 230, thereby preventing the main connector 200 from being moved forward and separated from the CPA device 300.

Figure 6:
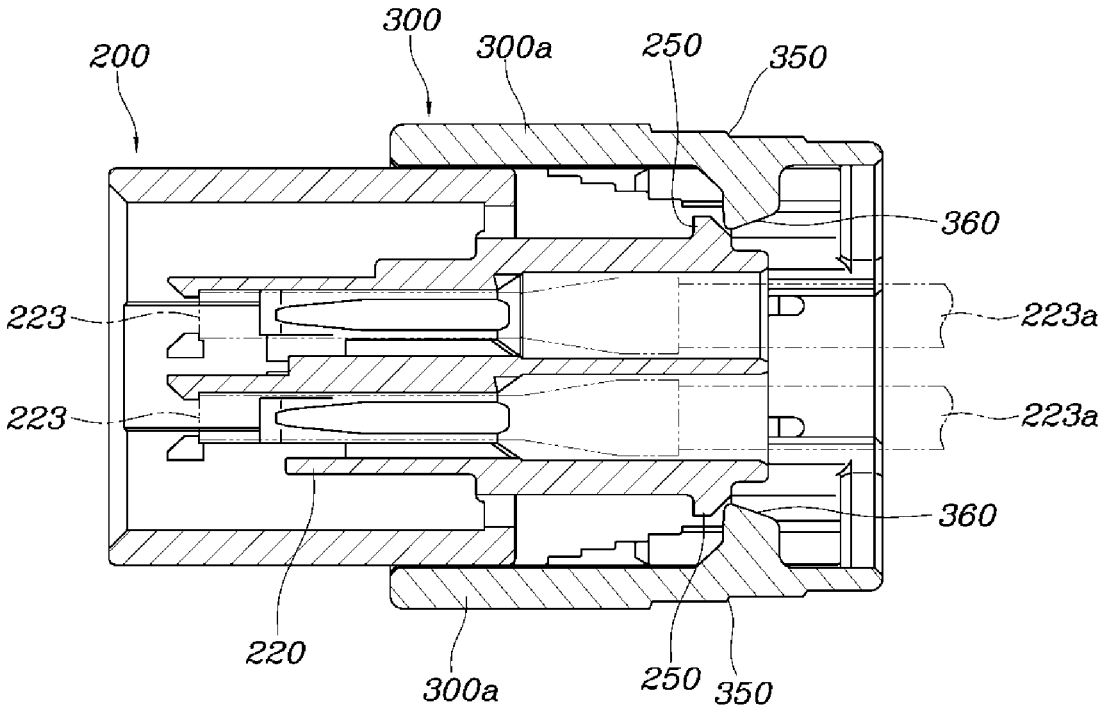
FIG. 6 is a side cross section view illustrating the connector of FIG. 1 with a connector position assurance (CPA) device moved to an assembling position, according to an embodiment of the present disclosure.

In addition, referring to FIG. 6, an interference protrusion 360 is formed on a side portion 300*a* of the CPA device 300 and a corresponding protrusion 250 corresponding to the interference protrusion 360 is formed on the main connector 200. Thereby, the side portion 300*a* of the CPA device 300 may be expanded and deformed as the interference protrusion 360 climbs up the corresponding protrusion 250 when the CPA device 300 is moved to an assembling position. Accordingly, the operator may perceive that the CPA device 300 is assembled by feeling the expansion of the CPA device 300 at the time of the assembly of the CPA device 300.

In particular, the locking arm 210 is deformably connected to an upper end of the terminal fastening part 220 formed inside the main connector 200 in a vertical direction. Here, an open space 240 that partially exposes the locking arm 210 is formed in the main connector 200 so as not to interfere with the deformation of the locking arm 210 in the vertical direction.

In detail, the locking arm 210 may include an elastic supporting part 221 upwardly protruding from the terminal fastening part 220 and formed to be elastically deformable; and a locker body 222 coupled to the elastic supporting part 221, formed to extend in a front-rear direction to seesaw around the elastic supporting part 221, and formed with an assembly space 222*d* into which the elastic arm 320 of the CPA device 300 is inserted.

Here, the number of the elastic supporting parts 221 may be plural for stable elastic support. The locker body 222 is rotated in the vertical direction as it is seesawed around the elastic supporting part 221 in a state of being coupled to the elastic supporting part 221 to thereby allow the locked state or the unlocked state to be switched.

In detail, the locker body 222 may include a coupling part 222*a* forming a lower end portion and coupled to the elastic supporting part 221, and a plate-shaped part 222*b* forming an upper end portion and closing an upper side of the assembly space 222*d*. A catching jaw 222*c* caught by the locking protrusion 110 of the counterpart connector 100 may be formed at a front end portion of the locker body 222, and a rear end portion of the locker body 222 may be opened toward the assembly space 222*d*.

Thereby, in a state in which the elastic arm 320 of the CPA device 300 is inserted into the lower end portion of the locker body 222 and the elastic arm 320 is inserted into the assembly space 222*d* of the locker body 222, a hooking jaw 321 which is in contact with and supported by the catching jaw 222*c* is formed on the elastic arm 320 such that the hooking jaw 321 is caught by the catching jaw 222*c* before the counterpart connector 100 and the main connector 200 are fully assembled. Thereafter, when the counterpart connector 100 and the main connector 200 are assembled, the hooking jaw 321 of the elastic arm 320 goes over the catching jaw 222*c* and is caught on the opposite side to thereby be in a locked state.

Figure 5:
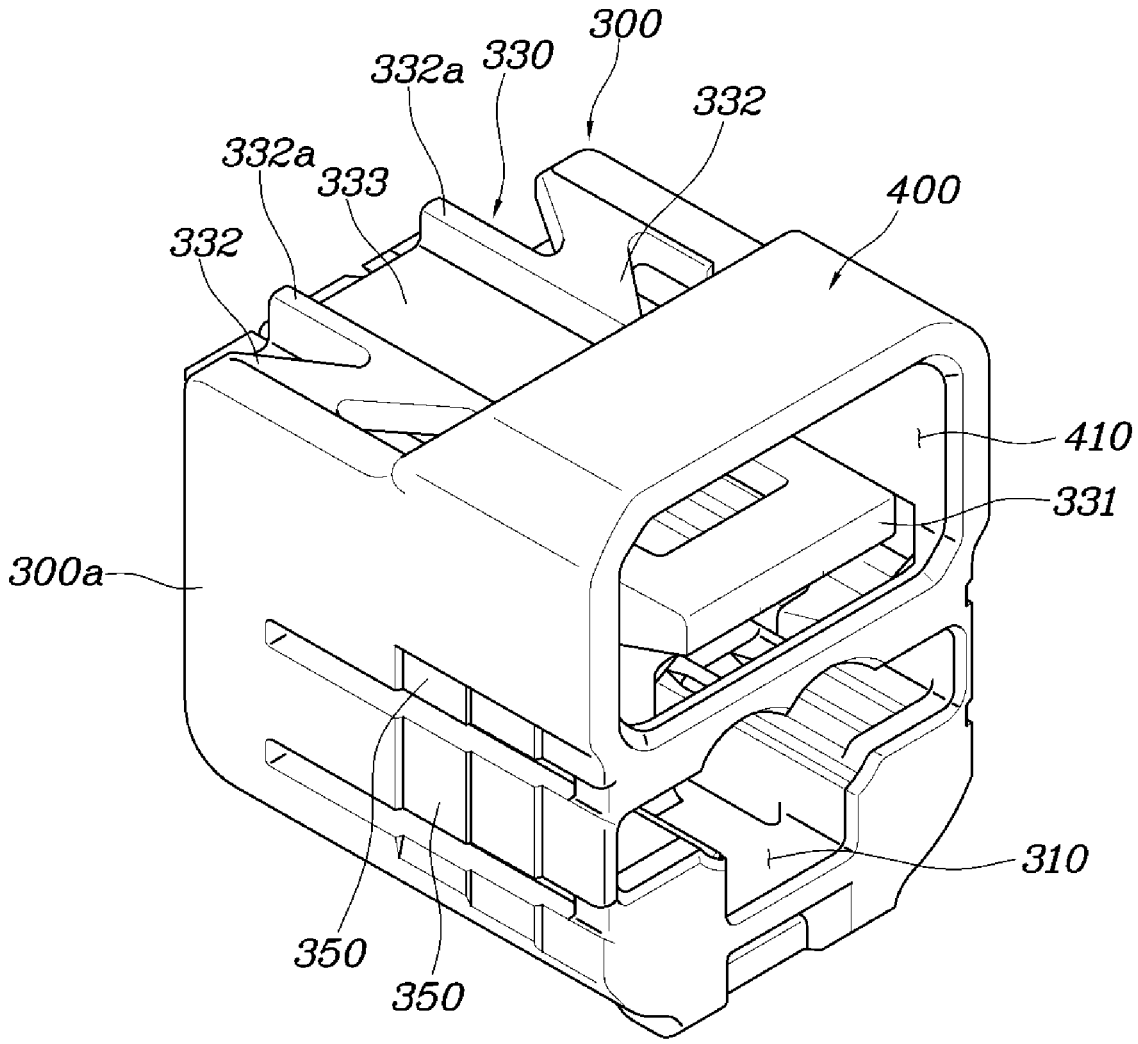
FIG. 5 is a rear perspective view of the connector device of FIG. 1, according to an embodiment of the present disclosure.

Meanwhile, as illustrated in FIGS. 2 and 5, the upper end portion of the CPA device 300 may be provided with a CPA catching part 330 extending in a width direction to be deformably connected to both side ends of the CPA device 300 in the vertical direction and having the elastic arm 320 formed thereon.

Figure 4:
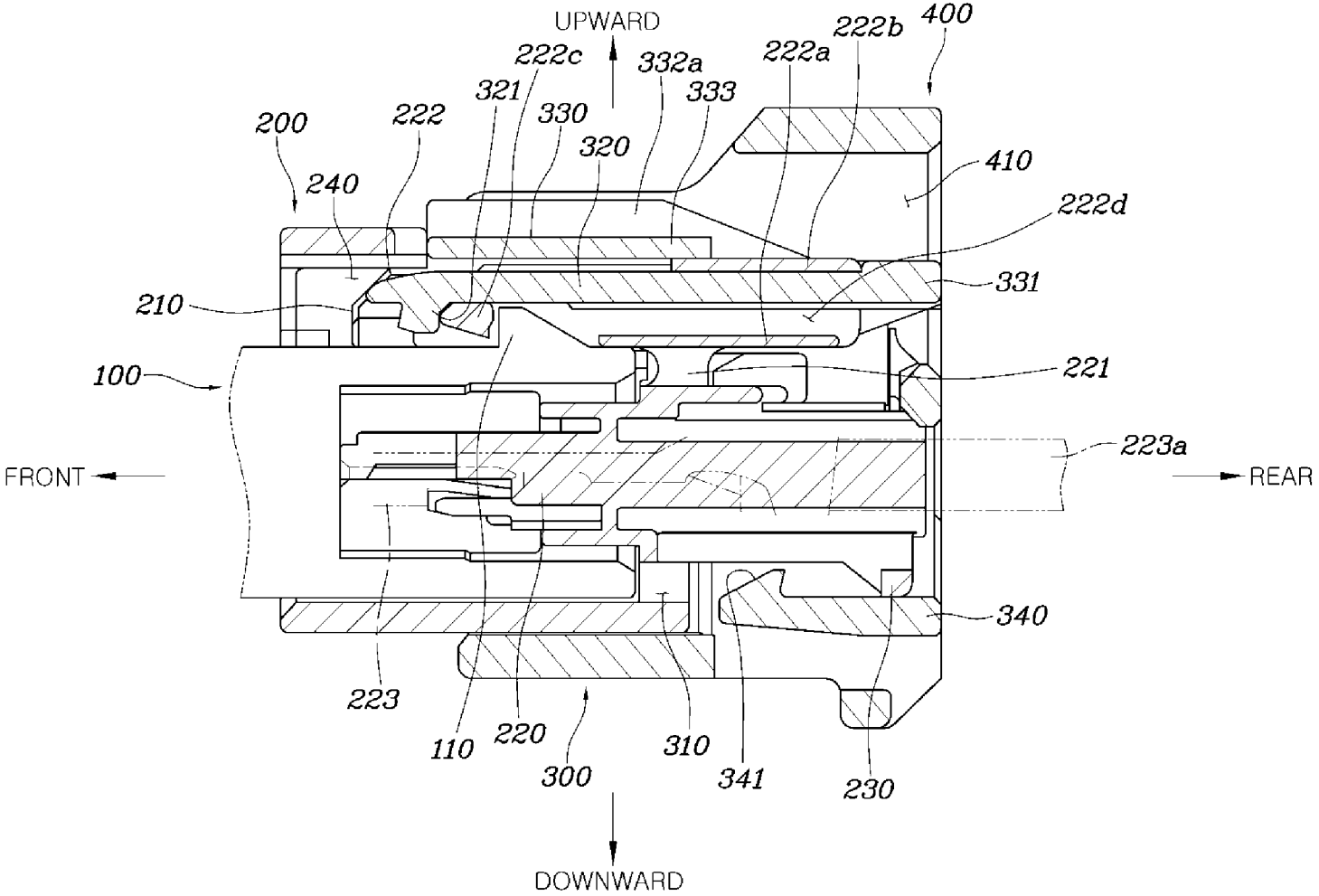
FIG. 4 is a side cross-section view illustrating the connector device of FIG. 1 with a main connector fully inserted into the accommodating part, according to an embodiment of the present disclosure.

Here, the CPA device 300 may be formed to surround the main connector 200, may have the accommodating part 310 into which the main connector 200 is inserted formed therein, and may be formed with a concave surface portion 350 having a height deviation in a stepwise manner on the side portion 300*a* in order to prevent slip when the operator holds the CPA device 300 and performs the assembly process. Such a CPA device 300 may be movable in the front-rear direction at a standby position at which the main connector 200 is partially inserted into the accommodating part 310 as illustrated in FIG. 2, and an assembly position at which the main connector 200 is fully inserted into the accommodating part 310 as illustrated in FIG. 4. To this end, the CPA device 300 and the main connector 200 may be connected to each other through a guide structure to be slide in a straight line direction.

In particular, the CPA catching part 330 of the CPA device 300 may include an extending part 331 disposed in a rear direction from the upper end portion of the CPA device 300 and extending in the width direction, an elastic arm 320 extending in a front direction from the extending part 331, connection parts 332 extending in the front direction from both end portions of the extending part 331 and then connected to both side ends of the CPA device 300, and a cover part 333 upwardly spaced apart from the elastic arm 320 and connected between the connection parts 332. Thereby, when manipulation force is applied to the extending part 331, the CPA device 300 may be rotated in the vertical direction with the connecting part 332 as a point so that the locked state may be switched.

Here, the elastic arm 320 and the cover part 333 are disposed to be parallel to each other to allow the plate-shaped part 222*b* to be inserted between the elastic arm 320 and the cover part 333 as illustrated in FIG. 2 when the CPA catching part 330 is inserted into the assembly space 222*d* of the locking arm 210. Thereby, the locking arm 210 and the elastic arm 320 may be interlocked and rotated together.

In addition, the connection part 332 is provided with a rib 332*a* protruding upwardly to reinforce rigidity thereof, and has an inclined with a descent gradient in a rear direction of the rib 332*a* so as not to interfere with the operation of the extending part 331. As illustrated in FIG. 5, such a connection part 332 may be formed in a plate shape extending from the front to the rear in an inclined manner to smoothly perform a rotational operation by the flexural deformation as the manipulation force is applied to the extending part 331.

Meanwhile, the hooking jaw 321 is formed on the elastic arm 320. As illustrated in FIG. 2, at the standby position, the hooking jaw 321 is in contact with a rear surface of the catching jaw 222*c* of the locking arm 210 to limit the movement of the elastic arm 320 to the assembly position. As illustrate in FIG. 4, as the assembly position, the hooking jaw 321 is in contact with a front surface of the catching jaw 222*c* to limit a movement in a direction returning to the standby position.

The cover part 333 is disposed to be spaced apart from the extending part 331 and is connected to a pair of connection parts 332.

Meanwhile, as illustrated in FIGS. 1 and 5, the bridge part 400 according to the present disclosure may be disposed at a rear end portion of the CPA device 300, and may connect both side ends of the CPA device 300 in the width direction and may be formed in an arch shape to form an opening 410 therein.

That is, the bridge part 400 may be formed integrally with the rear end portion of the CPA device 300, may be formed to cover the extending part 331 of the CPA catching part 330 and a rear portion of the elastic arm 320, and may have the opening 410 formed to allow the operator's finger to enter. As described above, the bridge part 400 is formed on the CPA device 300 to thereby prevent unintentional manipulation of the extending part 331 and the elastic arm 320 of the CPA catching part 330, and to prevent the unlocking by an erroneous manipulation because the extending part 331 and the elastic arm 320 may be operated only when the operator puts his/her finger into the opening 410 of the bridge part 400.

Hereinafter, an assembly and separation of the counterpart connector 100, the main connector 200, and the CPA device 300 according to the present disclosure will be described.

First, the CPA device 300 is assembled to the main connector 200. At such a standby position, as illustrated in FIG. 2, the catching protrusion 341 of the separation preventing arm 340 is in contact with the catching ring 230 to thereby prevent the CPA device 300 from being separated in a rear direction from the main connector 200. In addition, the hooking jaw 321 of the CPA device 300 is in contact with a rear surface of the catching jaw 222*c* of the locking arm 210 to thereby prevent the CPA device 300 from being moved in a front direction from the main connector 200.

In such a state, the counterpart connector 100 is coupled to the main connector 200. That is, as illustrated in FIG. 3, the catching jaw 222*c* formed on the locker body 222 is moved while climbing up the locking protrusion 110 of the counterpart connector 100, and in this case, the locker body 222 is seesawed in the vertical direction around the elastic supporting part 221. At the same time, the CPA catching part 330 is also rotated together with the locker body 222 around the connection part 332. Here, a rotation center point of the elastic supporting part 221 and a rotation center point of the connection part 332 may be disposed at the same position in the vertical direction so that the elastic arm 320 and the CPA catching part 330 do not interfere with each other when the elastic arm 320 and the CPA catching part 330 are rotated.

As described above, when the counterpart connector 100 and the main connector 200 are assembled to each other, the locker body 222 is returned to an original position and the catching jaw 222*c* of the locker body 222 is disposed to be caught by the front surface of the locking protrusion 110 of the counterpart connector 100. Meanwhile, the hooking jaw 321 of the elastic arm 320 climbs up the locking protrusion 110 to unlock the catching with the catching jaw 222*c*. Thereby, the CPA device 300 is allowed to move from the standby position to the assembly position, and the terminal part of the counterpart connector 100 and the terminal component 223 of the main connector 200 are connected to each other to be electrically connected to each other.

As described above, when the counterpart connector 100 and the main connector 200 are assembled to each other, the bridge part 400 formed on the CPA device 300 wraps the elastic arm 320 and the extending part 331 to thereby prevent the unlocking of the locked state due to application of unintentional manipulation force to the CPA catching part 330.

Meanwhile, when the counterpart connector 100 and the main connector 200 are separated from each other, the operator inserts the finger into the opening 410 of the bridge part 400 to thereby press the CPA catching part 330 downwardly. Thereby, the CPA catching part 330 is rotated together with the locker body 222 to unlock the catching with the locking protrusion 110 of the counterpart connector 100. Thereby, the separation of the counterpart connector 100 and the main connector 200 is allowed such that the counterpart connector 100 and the main connector 200 may be separated from each other.

As described above, according to the present disclosure, the bridge part 400 is formed on the CPA device 300 and covers an upper portion of the CPA catching part 330 including the elastic arm 320, such that the unintentional manipulation of the CPA catching part 330 may be prevented to maintain a connected state between the counterpart connector 100 and the main connector 200. In addition, the bridge part 400 may be connected integrally with the CPA device 300 to ensure the rigidity.

According to the connector device having the structure as described above, since a work direction of the main connector and a work direction of the CPA device are the same as each other, an assembly work for the counterpart connector may be simplified, and the bridge part formed on the CPA device wraps the elastic arm that determines the locked state, thereby preventing the unintentional unlocking due to carelessness.

Although the present disclosure has been shown and described with respect to specific embodiments, it will be apparent to those having ordinary skill in the art that the present disclosure may be variously modified and altered without departing from the spirit and scope of the present disclosure as defined by the following claims.

The invention claimed is:

1. A connector device comprising:

a counterpart connector having a locking protrusion formed thereon;

a main connector including a locking arm which is elastically flexural deformable, and maintaining a coupled state with the counterpart connector as the counterpart connector is inserted thereinto and the locking arm is caught by the locking protrusion;

a connector position assurance (CPA) device formed to wrap the main connector, having an accommodating part into which the main connector is inserted therein, and including an elastic arm caught by the locking arm and flexural deformed together with the locking arm when the main connector is inserted into the accommodating part, wherein the elastic arm is caught by the locking arm to restrict movement of the CPA device when the counterpart connector and the main connector are assembled, wherein an upper end portion of the CPA device is provided with a CPA catching part extending in a width direction to be deformably connected to both side ends of the CPA device in a vertical direction and having the elastic arm formed thereon; and a bridge part protruding from the CPA device and extended upwardly to wrap the elastic arm, and having an opening inwardly exposing the elastic arm.

2. The connector device of claim 1, wherein the main connector is provided with a terminal fastening part for terminal connection, and the locking arm is connected to an upper end of the terminal fastening part to be deformable in a vertical direction.

3. The connector device of claim 2, wherein the locking arm includes:

an elastic supporting part upwardly protruding from the terminal fastening part and formed to be elastically deformable; and a locker body coupled to the elastic supporting part, formed to be extended in a front-rear direction to seesaw around the elastic supporting part, and formed with an assembly space into which the elastic arm of the CPA device is inserted.

4. The connector device of claim 3, wherein the locker body includes a coupling part forming a lower end portion and coupled to the elastic supporting part, and a plate-shaped part forming an upper end portion and closing an upper side of the assembly space, a catching jaw caught by the locking protrusion of the counterpart connector is formed at a front end portion of the locker body, and a rear end portion of the locker body is opened toward the assembly space.

5. The connector device of claim 4, wherein in a state in which the elastic arm is inserted into the assembly space of the locker body, a hooking jaw which is in contact with and supported by the catching jaw is formed on the elastic arm.

6. The connector device of claim 1, wherein the CPA catching part includes an extending part disposed in a rear direction from the upper end portion of the CPA device and extending in the width direction, the elastic arm extending in a front direction from the extending part, connection parts extending in the front direction from both end portions of the extending part and then connected to both side ends of the CPA device, and a cover part upwardly spaced apart from the elastic arm and connected between the connection parts.

7. A connector device comprising:

a counterpart connector having a locking protrusion formed thereon;

a main connector including a locking arm which is elastically flexural deformable, and maintaining a coupled state with the counterpart connector as the counterpart connector is inserted thereinto and the locking arm is caught by the locking protrusion;

a connector position assurance (CPA) device formed to wrap the main connector, having an accommodating part into which the main connector is inserted therein, and including an elastic arm caught by the locking arm and flexural deformed together with the locking arm when the main connector is inserted into the accommodating part, wherein the elastic arm is caught by the locking arm to restrict movement of the CPA device when the counterpart connector and the main connector are assembled, wherein a catching ring is formed on the main connector, and a separation preventing arm corresponding to the catching ring is formed on the CPA device, such that the catching ring is caught by the separation preventing arm to prevent the main connector from being separated from the CPA device; and a bridge part protruding from the CPA device and extended upwardly to wrap the elastic arm, and having an opening inwardly exposing the elastic arm.

8. A connector device comprising:

a counterpart connector having a locking protrusion formed thereon;

a main connector including a locking arm which is elastically flexural deformable, and maintaining a coupled state with the counterpart connector as the counterpart connector is inserted thereinto and the locking arm is caught by the locking protrusion;

a connector position assurance (CPA) device formed to wrap the main connector, having an accommodating part into which the main connector is inserted therein, and including an elastic arm caught by the locking arm and flexural deformed together with the locking arm when the main connector is inserted into the accommodating part, wherein the elastic arm is caught by the locking arm to restrict movement of the CPA device when the counterpart connector and the main connector are assembled; and a bridge part protruding from the CPA device and extended upwardly to wrap the elastic arm, and having an opening inwardly exposing the elastic arm, wherein the bridge part is disposed at a rear end portion of the CPA device, and connects both side ends of the CPA device in a width direction and is formed in an arch shape to form an opening therein.

* * * * *